US008079380B2

(12) United States Patent
Engstrom et al.

(10) Patent No.: US 8,079,380 B2
(45) Date of Patent: Dec. 20, 2011

(54) PORTABLE ICE HOUSE

(75) Inventors: Jay Engstrom, Luck, WI (US); Randy Schamberger, Barron, WI (US); Griffith Ruppel, Cumberland, WI (US); Ben Nelson, Cameron, WI (US)

(73) Assignee: Ardisam, Inc., Cumberland, WI (US)

( * ) Notice: Subject to any disclaimer, the term of this patent is extended or adjusted under 35 U.S.C. 154(b) by 0 days.

(21) Appl. No.: 12/491,413

(22) Filed: Jun. 25, 2009

(65) Prior Publication Data

US 2009/0320893 A1 Dec. 31, 2009

Related U.S. Application Data

(60) Provisional application No. 61/076,466, filed on Jun. 27, 2008.

(51) Int. Cl.
*E04H 15/06* (2006.01)

(52) U.S. Cl. ..... 135/96; 135/88.13; 135/133; 135/901; 296/159; 296/161; 403/109.3

(58) Field of Classification Search ..... 135/88.15, 135/96, 132–134, 138, 116, 117, 901, 88.08–88.09, 135/142, 151; 248/219.1, 188.1; 403/109.2–109.3, 403/109.7, 109.8, 227; 114/361, 344; 297/218.2, 297/184.11, 184.15; 296/159–161, 163, 296/181.7, 182.1
See application file for complete search history.

(56) References Cited

U.S. PATENT DOCUMENTS 3,103,375 A * 9/1963 McMullin ..... 403/300
3,513,861 A * 5/1970 Johnson ..... 135/132
4,239,247 A 12/1980 Hinz
4,612,948 A * 9/1986 Simpson ..... 135/130
4,683,672 A * 8/1987 Davis ..... 43/1
4,683,900 A * 8/1987 Carmichael ..... 135/88.01
4,830,035 A * 5/1989 Liu ..... 135/67
5,271,423 A * 12/1993 Eychaner ..... 135/134
5,720,312 A * 2/1998 Scheuermann ..... 135/88.09
5,884,646 A * 3/1999 Ju ..... 135/135
6,338,587 B1 * 1/2002 Kuo ..... 403/109.7
6,397,870 B1 6/2002 Makedonsky et al.
6,439,645 B1 * 8/2002 Pedersen ..... 296/161
6,938,927 B1 * 9/2005 Martin et al. ..... 280/819
6,962,221 B1 * 11/2005 Carrette ..... 180/9.1
7,640,942 B2 * 1/2010 Chu ..... 135/132
2006/0238005 A1 10/2006 Walter et al.

OTHER PUBLICATIONS

Clam Corp, Inc., manual 102179 for Fish Trap X2, 2008.

* cited by examiner

*Primary Examiner* — Winnie Yip
(74) *Attorney, Agent, or Firm* — Stoel Rives LLP

(57) ABSTRACT

An ice house including a collapsible frame assembly. The collapsible frame assembly includes at least one first pole with a connecting end having a plunger assembly. At least one second pole has a hollow end sized to telescopically engage with the plunger assembly and the first pole. The second pole has at least one detent proximate a connecting end sized to releasably engage with a plunger on the plunger assembly. An actuator assembly includes a first end secured to the connecting end of the second pole and a second end adapted to telescopically receive the plunger assembly and the first pole. The actuator assembly includes an actuator located over the detent and configured to flex between a relaxed position and a depressed position that disengages the plunger from the detent. A seat assembly is secured to the frame assembly and a cover having at least one door is attached to the frame assembly.

14 Claims, 9 Drawing Sheets

PORTABLE ICE HOUSE

The present application claims the benefit of U.S. Provisional Application No. 61/076,466 entitled Ice House, filed Jun. 27, 2008, which is hereby incorporated by reference.

FIELD OF THE INVENTION

The present invention relates generally to collapsible and portable ice houses.

BACKGROUND OF THE INVENTION

Ice fishing is a popular winter past time in northern climates. Ice fishing is the activity of catching fish through an opening in the ice on a frozen body of water such as a lake, river, or pond. Ice houses, also known as ice shanties in some locations, are small shelters that are used to protect an ice angler from the elements including wind and blowing snow. Typically, an ice house includes room for one to six anglers and their gear. Some ice houses are more permanent structures, and are towed to their location using a vehicle such as a truck or four-wheeler. Other ice shelters are portable and can be easily moved by the anglers themselves and quickly set-up at different locations. Various ice house structures mounted on sleds are disclosed in U.S. Pat. Nos. 4,239,247, 6,397,870 and U.S. Patent Publication No. US2006/0238005, which are hereby incorporated by reference.

In order to quickly assemble and take-down the frame of a portable ice house, the ice angler must typically remove their gloves to improve dexterity and to avoid getting pieces of their gloves caught in the frame assembly. Even with gloves removed anglers often find it difficult to operate latch mechanisms that are coated with ice and snow or frozen.

BRIEF SUMMARY OF THE INVENTION

The present invention is directed to an ice house with a collapsible frame assembly that facilitates quick set-up and take-down, without the need for the ice angler to remove their winter protective gear. The frame members are telescopically engaged to facilitate quick assembly and disassembly. The connecting end of the frame members are connected by a plunger assembly housed in an actuator assembly. The actuator assembly protects the plunger assembly from the elements and facilitates operation with gloved hands. The frame assembly can be secured to a sled or free-standing. According to another embodiment, the ice house can also include a seat assembly secured to the frame assembly and a cover including at least one door provided over the frame assembly.

In one embodiment, the ice house includes collapsible frame assembly including at least one first pole with a connecting end having a plunger assembly. At least one second pole has a hollow end sized to telescopically engage with the plunger assembly and the first pole. The second pole has at least one detent proximate a connecting end sized to releasably engage with a plunger on the plunger assembly. The actuator assembly includes a first end secured to the connecting end of the second pole and a second end adapted to telescopically receive the plunger assembly and the first pole. The actuator assembly includes an actuator located over the detent and configured to flex between a relaxed position and a depressed position that disengages the plunger from the detent. A seat assembly is secured to the frame assembly and a cover having at least one door is attached to the frame assembly.

The actuator assembly preferably shields the plunger assembly from ice and snow. The actuator can be connected to the actuator assembly by a living hinge, a mechanical hinge, a flexible web, or a variety of other mechanisms. In one embodiment, the actuator includes a protrusion opposite the detent that depresses the plunger into the hollow end of the second pole. A distal end of the actuator is preferably located over the detent so that a force applied to an external surface of the actuator is concentrated on the plunger. An external surface on the actuator is preferably at least 10 times larger than a surface area of a distal end of the plunger. A raised feature aligned with the plunger is preferably provided on an external surface of the actuator.

In one embodiment the plunger assembly includes a housing having a diameter sized to fit in a hollow end of the first pole and a spring located in a recess in the housing that is configured to bias the plunger through a hole in the connecting end of the first pole. In another embodiment, the plunger assembly includes an alignment member extending beyond the connecting end and sized to fit in the hollow end of the second pole. The actuator assembly permits one handed operation of the plunger assembly.

The present invention is also directed to an actuator assembly for an ice house having a collapsible frame assembly with a plurality of first and second poles. The actuator assembly includes a plunger assembly attached to a connecting end of at least one first pole. The plunger assembly includes at least one plunger protruding through a hole in the connecting end of the first pole. The actuator assembly includes a first end secured to a connecting end of at least one second pole. A second end of the actuator assembly is adapted to telescopically receive the plunger assembly and the first pole. The actuator assembly includes an actuator located over a detent in the second pole sized to receive the plunger. The actuator is configured to flex between a relaxed position and a depressed position that disengages a plunger from the detent.

The present invention is also directed to a method of disassembling telescopically engaged first and second poles of a collapsible frame assembly for an ice house. The method includes the steps of grasping an actuator assembly attached to the second pole. The actuator assembly overlaps a plunger assembly attached to the first pole. The plunger assembly includes a plunger that extends from the first pole through a detent on the second pole. The actuator assembly shields the plunger assembly from ice and snow. The actuator on an actuator assembly that is aligned with a plunger in the plunger assembly is depressed a sufficient amount to disengage the plunger from the detent on the second pole. The first pole is then slide relative to the second pole. The first and second poles can remain telescopically engaged or can separate.

DETAILED DESCRIPTION OF THE INVENTION

Figure 1A:
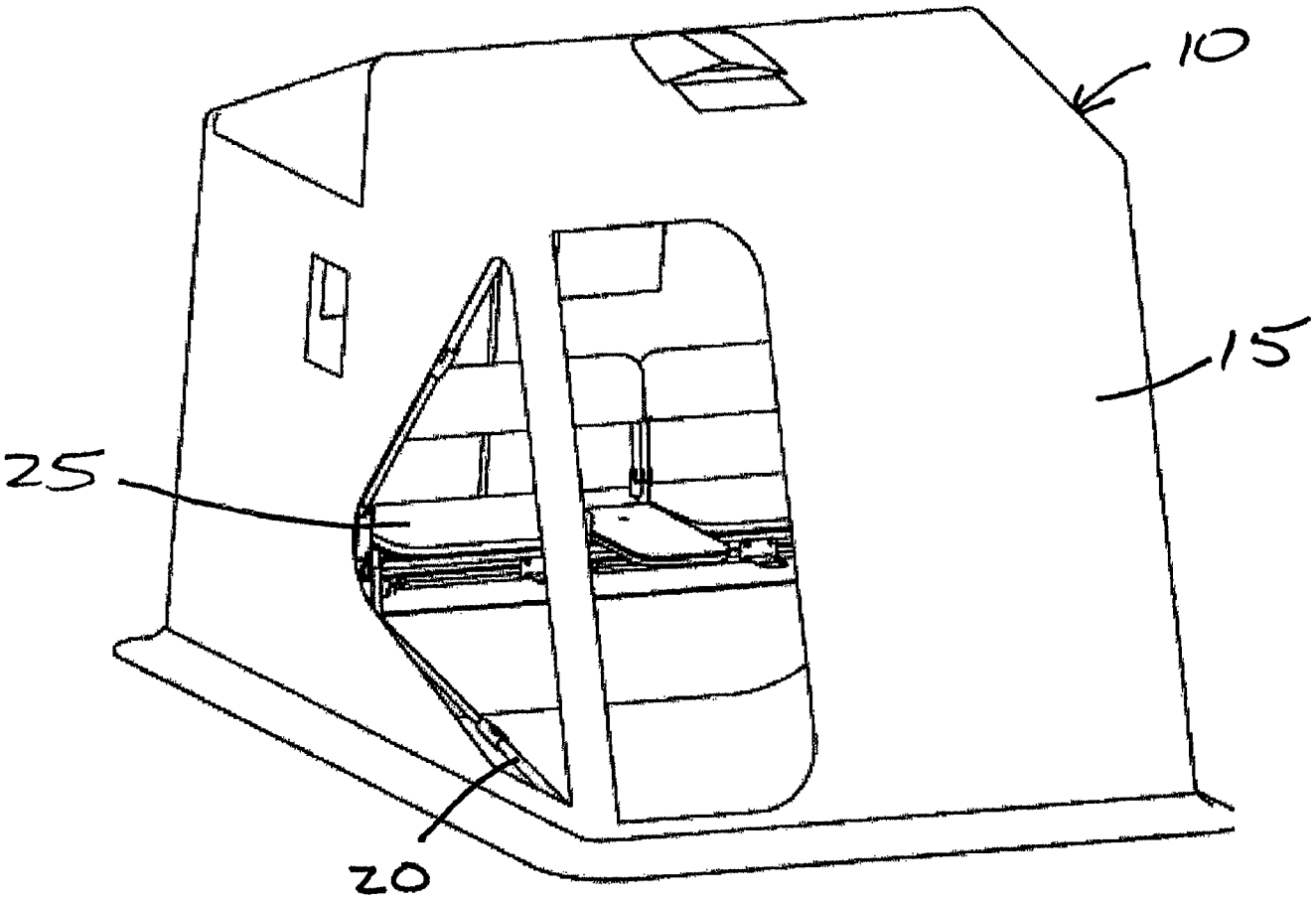
FIGS. 1A and 1B are partial cut-away views of a portable ice house provided in accordance with an embodiment of the present invention.

In the description which follows, like parts or elements are marked throughout the specification and drawings with the same reference numerals, respectively. The drawing figures are not necessarily to scale and certain features may be shown in somewhat generalized or schematic form in the interest of clarity and conciseness.

Figure 1B:
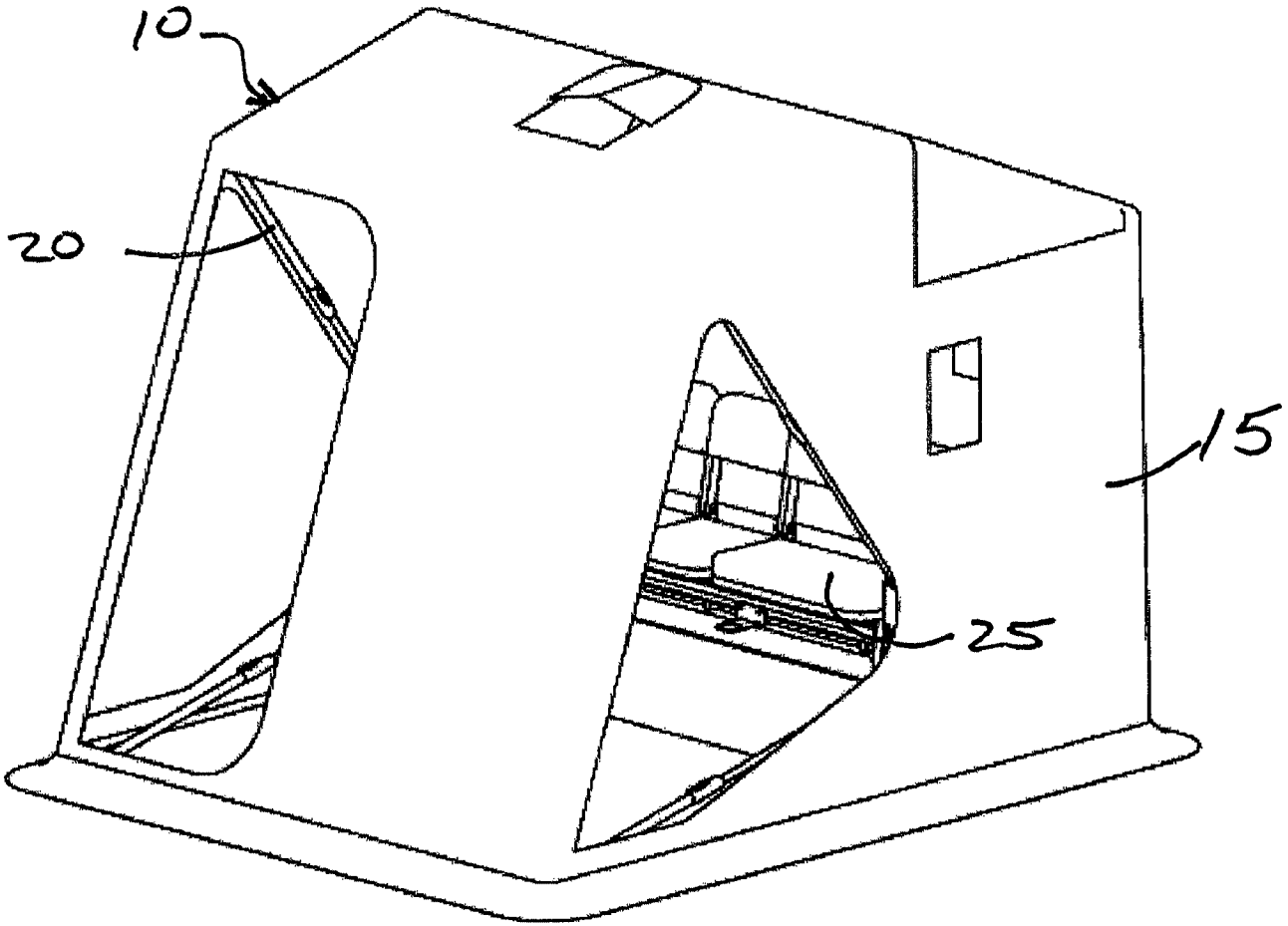

FIGS. 1A and 1B are perspective views of an ice house 10 including a cover 15 provided over a collapsible frame assembly 20. In some embodiments, the ice house 10 also includes a seat assembly 25 coupled to the collapsible frame assembly 20. According to various embodiments, the ice house 10 is adapted for quick set-up and take-down by the ice anglers. Additionally, the ice house 10 is portable and can be easily transported to different locations on the ice. In some embodiments, the ice house 10 can be transported to a desired location by pulling the ice house 10 on a sled or runners (See FIG. 3B). In other embodiments, the collapsed ice house 10 can be towed behind an all terrain vehicle, snowmobile, or other vehicle. In still other embodiments, the ice house 10 may be free-standing.

The ice house or ice shanty 10 can be sized and dimensioned to accommodate any number of ice anglers, their gear, and, in some cases, a small heater or stove. In some embodiments, the ice house 10 can be sized to accommodate one to three ice anglers. In other embodiments, the ice house 10 can be sized to accommodate more than four ice anglers. The ice house 10 is sized to provide enough room for an ice angler to sit comfortably on the seat assembly 25 with plenty of headroom next to a fellow ice angler while holding their fishing pole over one or more ice fishing holes.

Figure 2:
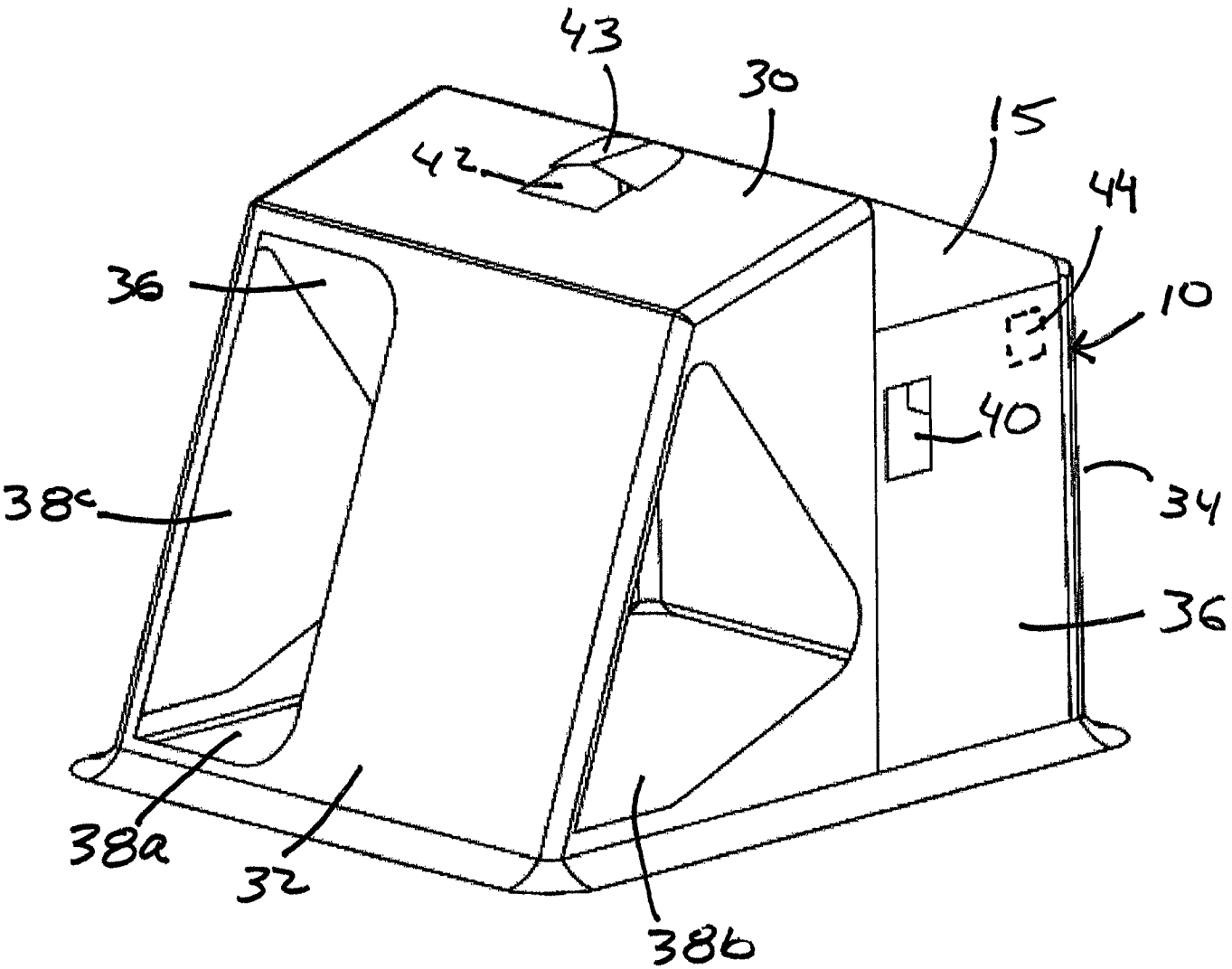
FIG. 2 is a perspective view of a cover for an ice house frame assembly provided in accordance with an embodiment of the present invention.

FIG. 2 is a perspective view of a cover 15 according to various embodiments of the present invention. The cover 15 is provided over the collapsible frame assembly 20 (see FIG. 1A) and protects the ice anglers inside the ice house 10 from the winter elements. In some embodiments the cover can be secured to the collapsible frame assembly 20 by a plurality of Velcro loops or ties. According to various embodiments, the cover 15 is made from breathable, flame-retardant, water-resistant, wind-resistant material. The material selected for the cover 15 should maintain a relatively comfortable environment inside the ice house 10.

As shown in FIG. 2, the cover 15 includes a top 30, a front wall 32, a rear wall 34, and two side walls 36. Additionally, the cover 15 includes one or more doors 38*a*, 38*b*, 38*c* (collectively "38") for providing access to the interior of the ice house 10. In the illustrated embodiments, the cover 15 includes one front door 38*a* and two side doors 38*b* and 38*c*. Providing two side doors 38*b* and 38*c* allows the ice anglers to exit from either side of the ice house 10 without disturbing their fellow ice anglers and/or their fishing lines. In certain embodiments, the cover 15 may include a door in the rear wall 34 (not shown). The doors 38 can be secured using zippers, snaps, or other similar fastening devices. The fastening devices should be easy to operate by an ice angler without the need for removing their winter gloves. Additionally, according to various embodiments, the doors 38 are sufficiently dimensioned such that they facilitate an ice angler to enter and exit the ice house 10 without tripping over the door opening, their fellow ice anglers, and/or their gear.

According to one embodiment, as shown in FIG. 2, the cover 15 also includes at least one window 40. The windows 40 are located in one or both of the side walls 36 and, in some embodiments, also the back wall 34 of the cover 15. The side windows are made from clear vinyl to facilitate entry of daylight into the ice house 10, and to allow the occupants inside the ice house 10 the ability to look out and view the surroundings. In some embodiments, the windows 40 can be provided with a window covering (not shown) such as a pair of flaps or a roll-up covering. The roll-up covering can be secured in an open position with ties, snaps, or other fastening devices.

The cover 15 also includes at least one skylight 42 located in the top 30 of the cover 15. In some embodiments, the cover 15 can include two or more skylights 42. According to some embodiments, the skylight 42 includes clear vinyl portion 43 to facilitate entry of additional daylight into the ice house 10. In some embodiments, the clear vinyl portion 43 is removable, allowing the skylight 42 to also serve as a vent.

According to various embodiments, the cover 15 also includes at least one vent 44. In some embodiments, the cover 15 includes a vent 44 located in each of the side walls 36. The vent(s) 44 can include a mesh portion to prevent snow and ice from entering the ice house. Additionally, the vent(s) 44 may be provided with a cover that can be secured over the vent using snaps, Velcro strips, or other fastening devices. The vent(s) 44 are configured to allow heated air to escape from inside the ice house to prevent build-up of condensation. Additionally, the vent(s) 44 facilitate fresh air to enter into the ice house 10. A vent 44 is particularly useful when a heater or stove is used inside the ice house.

In some embodiments, the cover 15 may also include one or more outer pockets (not shown) for displaying a fishing license or other appropriate permit.

Figure 3A:
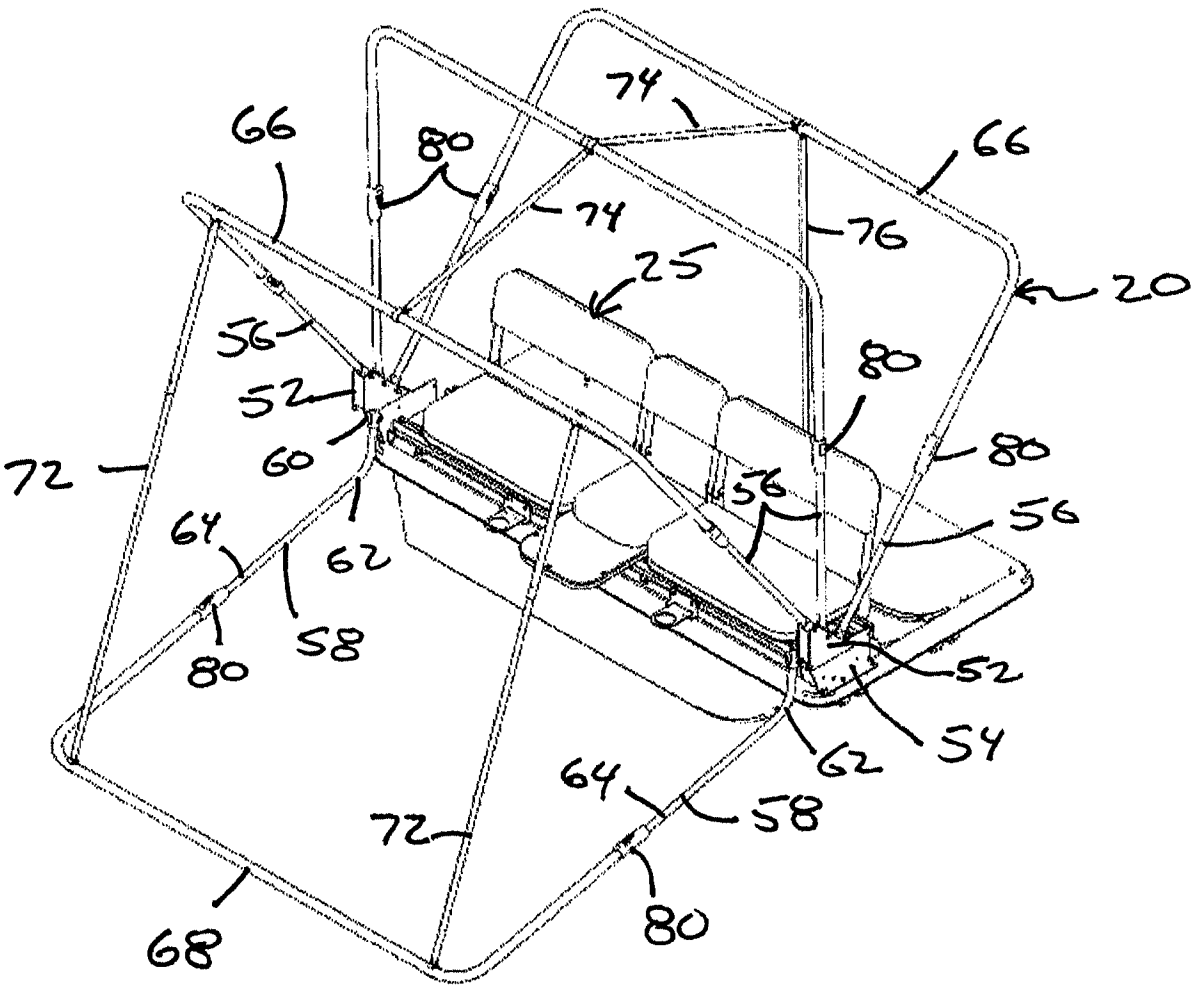
FIG. 3A is perspective view of a collapsible ice house frame assembly provided in accordance with an embodiment of the present invention.
Figure 3B:
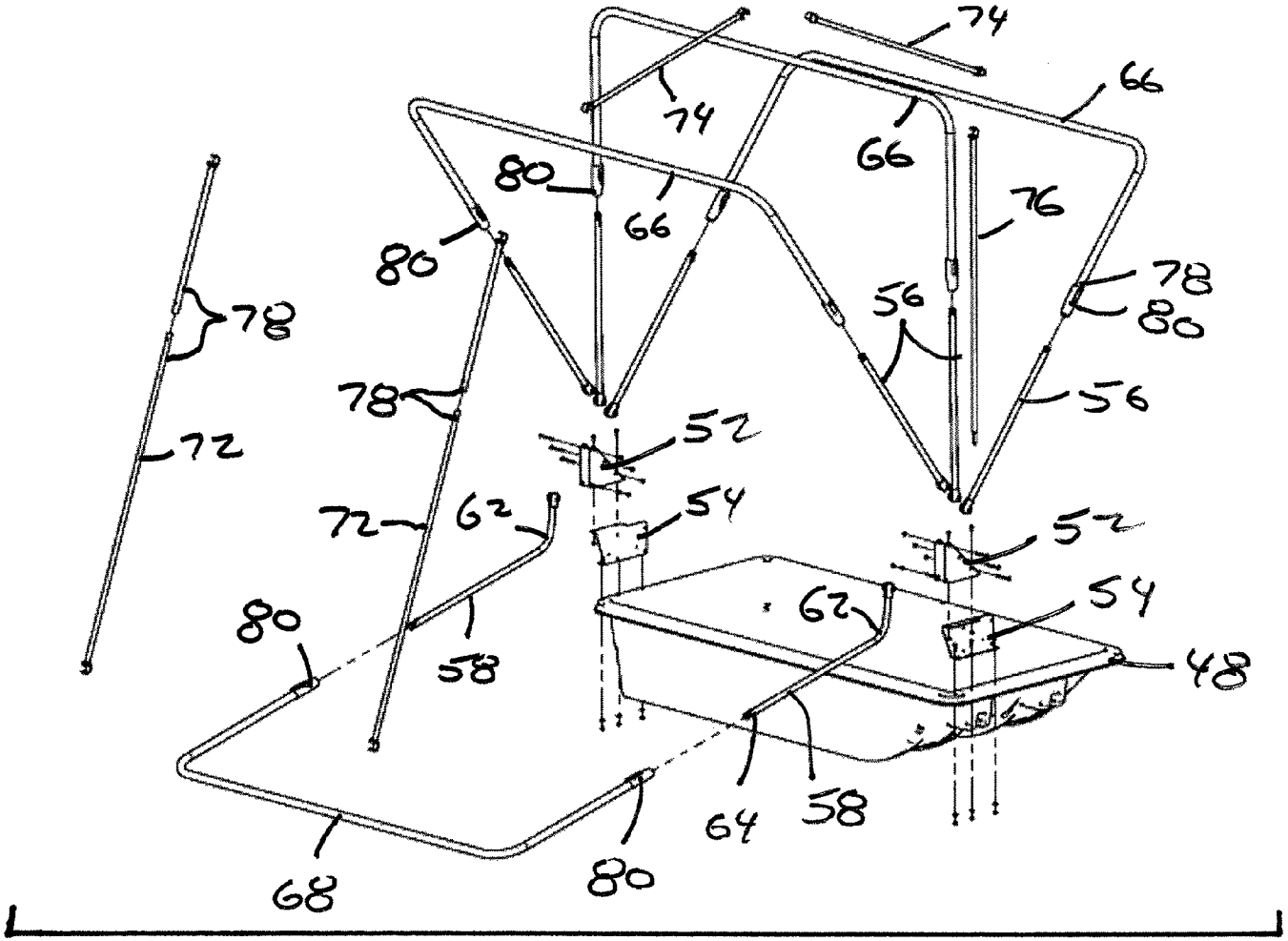
FIG. 3B is an exploded view of the collapsible frame assembly provided shown in FIG. 3A.

FIG. 3A is a perspective view of a collapsible frame assembly 20 according to an embodiment of the present invention. FIG. 3B illustrates an exploded view of the collapsible frame assembly 20 mounted on sled 48.

As shown in FIG. 3A, a seat assembly 25 is secured to the frame assembly 20. In one embodiment, the seat assembly 25 is a folding seat assembly. As shown in FIG. 3B, the frame assembly 20 and seat assembly 25 can be secured to a sled 48 using a plurality of fasteners known to those of skill in the art. The sled 48 provides a supportive base for the seat assembly 25, and can be used for transporting the ice house 10 from one location to another. In some embodiments, the sled 48 may include at least one pair of runners (not shown). The runners may be added to the sled 48 after manufacture using a kit.

As shown in FIGS. 3A and 3B, the frame includes a pair of canopy brackets 52 secured to either side of the sled 48 via a pair of mounting brackets 54. According to one embodiment, three pairs of straight poles 56 are rotatable with respect to canopy brackets 52 located on either side of the sled 48 such that the straight poles 56 are able to rotate to a raised configuration. Additionally, a pair of bent poles 58 is coupled to a lower, front portion 60 of each of the canopy brackets 52. Each of the bent poles 58 includes a bent portion 62 and a straight portion 64. In one embodiment, the straight portions 64 of each of the bent poles 58 are configured to lie flat on the surface where the ice house 10 is being erected The frame assembly 20 also includes a plurality of cross-brace poles 66 adapted to couple to the each pair of straight poles 56 and an additional front cross-brace pole 68 adapted to couple to the straight portions 64 of each of the bent poles 58. Additionally, as shown FIG. 3A and 3B, the frame assembly 20 includes a pair of front spreader poles 72, at least two roof spreader poles 74, and a rear spreader pole 76. The length of spreader poles 72 and/or 76 may be adjustable. Each of the spreader poles 72, 76 is adapted to be coupled to the appropriate cross-brace pole 66, 68.

The poles 56, 58, 66 and/or 68 can be made of metal such as aluminum, aluminum alloys, titanium and titanium alloys, and other suitable materials known in the art. Additionally, the poles 56, 58, 66, and 68 can have any suitable cross-sectional configuration to provide strength and minimal weight. For example, the poles can have a circular, square, diamond, or a hexagonal cross-section. According to one embodiment, the poles 56, 58, 66, and 68 have a circular cross-section.

Figure 3C:
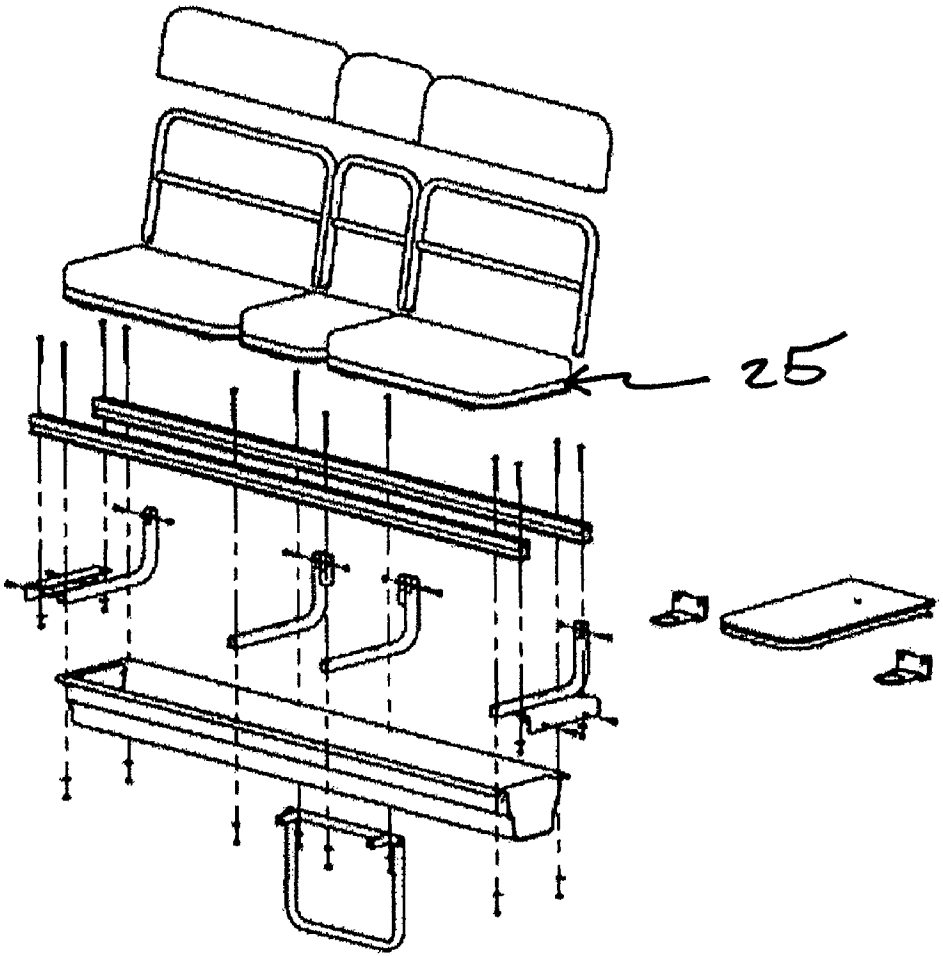
FIG. 3C is an exploded view of the seat assembly illustrated in FIG. 3A.
Figure 4A:
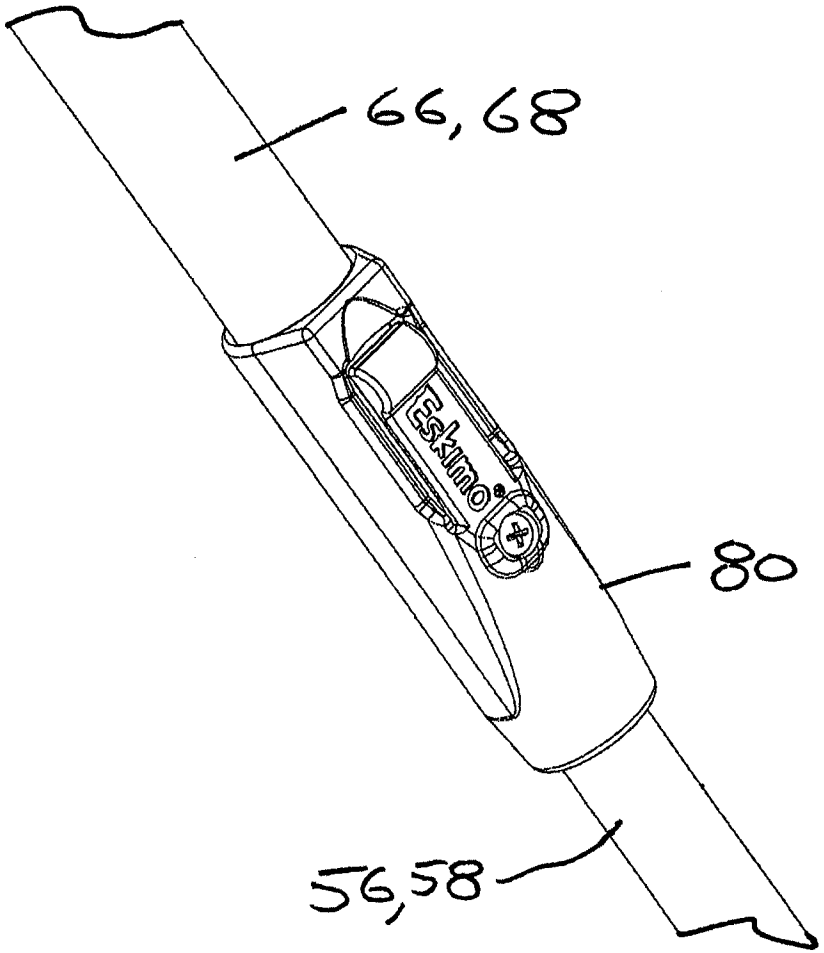
FIG. 4A is a perspective view of an actuator assembly engaged with poles in accordance with an embodiment of the present invention.
Figure 4B:
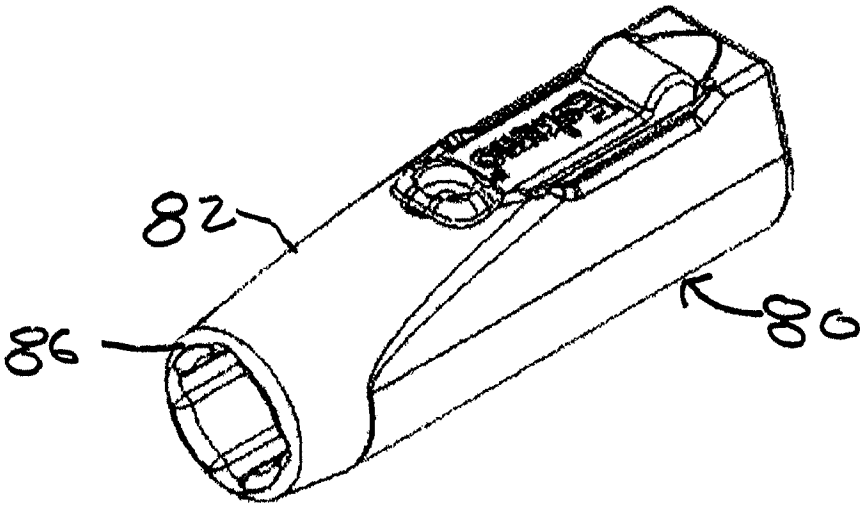
FIG. 4B is a perspective view of an actuator assembly in accordance with an embodiment of the present invention.
Figure 4D:
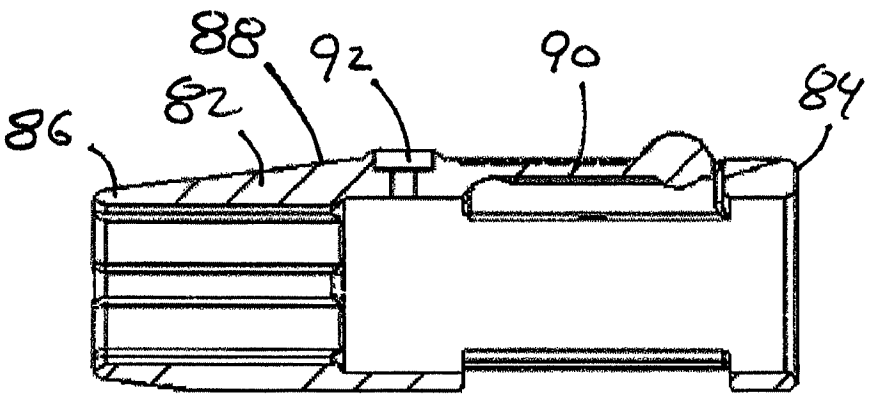
FIG. 4D is a cross-sectional view of the actuator assembly shown in FIG. 4B.
Figure 4C:
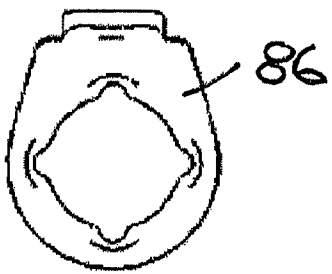
FIG. 4C is an end view of the actuator assembly shown in FIG. 4B.

According to various embodiments, the straight poles 56 and the straight portions 64 of the bent poles 58 have a smaller diameter than the cross-brace poles 66 and 68. The straight poles 56 and the straight portions 64 are configured to be inserted or to telescope into the larger diameter cross-brace poles 66 and/or 68. FIG. 3C is an exploded view of the collapsible seat assembly 25 shown in FIG. 3A. The seat assembly is intended to be mounted to the mounting brackets 54.

According to various embodiments of the present invention, actuator assembly 80 are preferably located at one of the connecting ends 78 to facilitate engagement of the poles 56, 58, 66, 68. FIG. 4A through 4D illustrate various views of an actuator assembly 80. The actuator assembly 80 are preferably secured to the connecting ends 78 of the larger diameter cross-brace poles 66 and/or 68 using a variety of techniques, such as for example by mechanical fasteners, adhesives, and the like.

The actuator assembly 80 includes a tubular member or sleeve 82 having a first end 84, a second end 86, and an upper portion 88. An actuator 90 is attached to the sleeve 82 at upper portion 88. Fastener 92 (e.g., screw) is provided for securing the clip 80 to the connecting end 78 of the poles 66, 68.

Figures 5A, 5B:
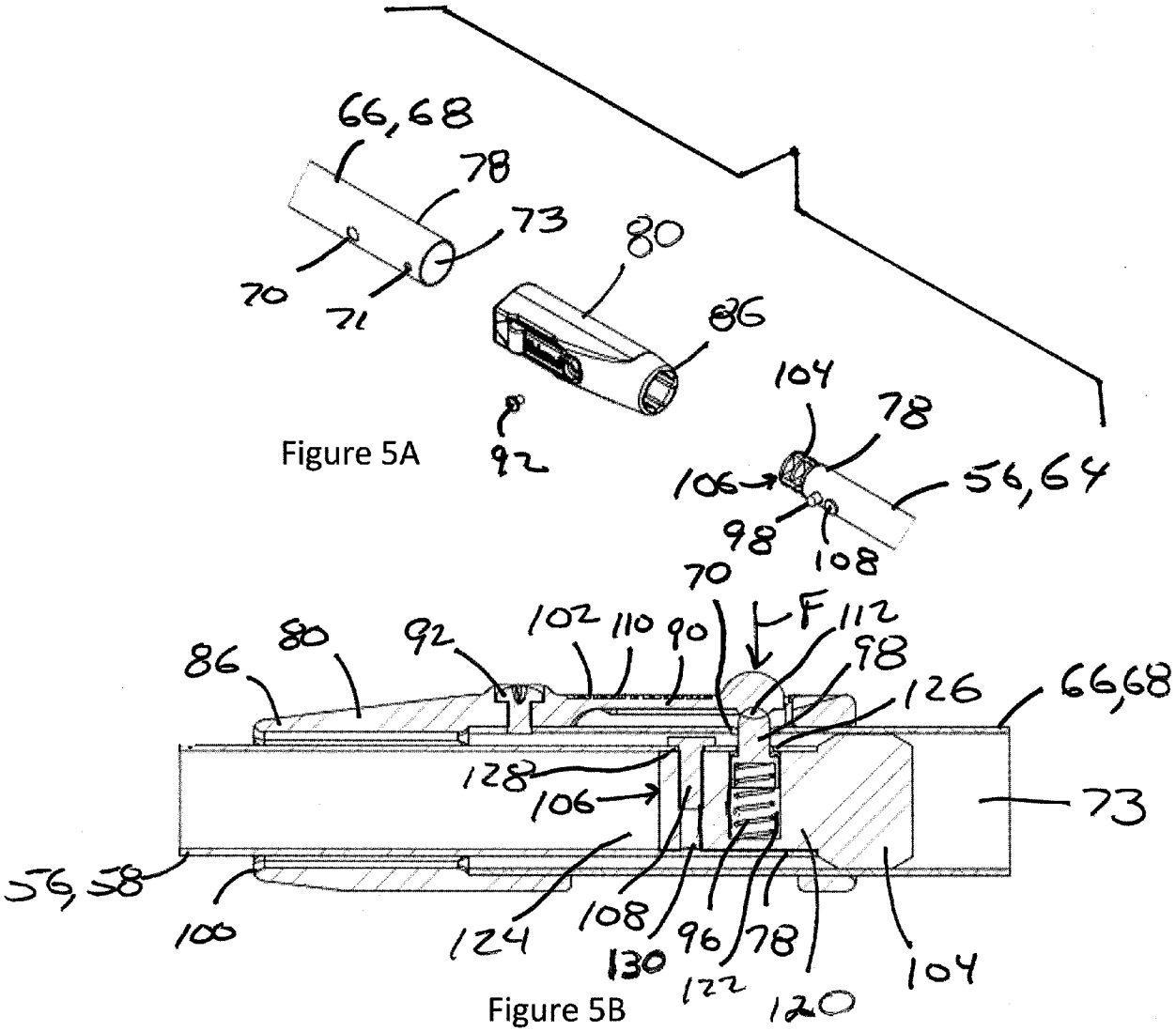
FIG. 5A is an exploded view of the actuator assembly of FIG. 4A.
FIG. 5B is a side sectional view of the actuator assembly of FIG. 4A.

As best illustrated in FIGS. 5A and 5B, the larger diameter poles 66, 68 include detent 70 and fastener hole 71. The detent 70 is preferably sized and shaped to receive plunger 98. In the illustrated embodiment, the detent 70 is a hole in the sidewall of the poles 66, 68. The fastener 92 engages with fastener hole 71 to attach the actuator assembly 80 to the larger diameter poles 66, 68.

Plunger assembly 106 is attached to connecting end 78 of smaller diameter poles 56, 58 with fastener 108. The plunger assembly 106 includes housing 120 with a recess 122 that retains spring 96 and the plunger 98 configured to releasably engage with detent 70 in the larger diameter poles 66, 68. Housing 120 also includes alignment member 104 extending past the connecting end 78. The alignment member 104 is sized to engage with hollow end 73 of the poles 66, 68. The alignment member 104 can be a separate piece or may be integrally formed with the housing 120.

In the illustrated embodiment, the plunger assembly 106 is attached to the connecting end 78 of the poles 56, 58 by depressing plunger 98 into recess 122. The plunger assembly 106 is inserted into hollow end 124 in one of the poles 56, 58 until the plunger 98 engages with hole 126 at connecting end 78. Fastener 108 is then inserted though hole 128 into hole 130 in the housing 120.

In operation, the alignment member 104 is inserted into the second end 86 of the actuator assembly 80. Curved surface 100 at the second end 86 depresses the plunger 98 to permit further insertion into the actuator assembly 80 until the plunger 98 is aligned with the detent 70 in one of the poles 66, 68. Once aligned, the spring 96 automatically pushes the plunger 98 into engagement with the detent 70, mechanically locking one of the poles 56, 58 to one of the poles 66, 68.

In the mechanically locked position illustrated in FIG. 5B, the actuator 90 is aligned with the plunger 98. The actuator 90 is configured to flex in region 102 between a relaxed position and a depressed position within the tubular member 82. The actuator 90 can be coupled to the actuator assembly 80 via one or more mechanical hinges. In another embodiment, the actuator 90 is integrally formed with the actuator assembly 80 so that the region 102 comprises a living hinge or a flexible web. The region 102 is preferably located offset from the plunger 98 so that any force applied to external surface 110 of the actuator 90 is concentrated on the plunger 98.

External surface 110 of the actuator 90 includes raised portion 94 that facilitates operation with the user's thumb or one or two fingers on a single hand. The raised portion 94 serves as a guide for pressing on the actuator 90 and focuses the compressive force F on the spring loaded button plunger 98. The raise portion 94 is preferably located directly over the plunger 98 to concentrate the force F at that location. The external surface 110 has a surface area at least 10 times the surface area of a distal end of the plunger 98, facilitating operation while wearing gloves.

Protrusion 112 on the actuator 90 is positioned over the plunger 98. The protrusions 112 preferably has a diameter less than the diameter of detent 70 in the poles 66, 68. Consequently, force F advances the protrusion 112 into the detent 70 and depresses the plunger 98 below the hollow end 73 of the poles 66, 68, permitting the poles 56, 58 to slide telescopically within the poles 66, 68 and/or be disengaged from the actuator assembly 80.

Quick assembly and take-down of the frame assembly 20 minimizes an ice angler's prolonged exposure to the weather elements and maximizes the amount of time for fishing. The actuator assembly 80 permits an ice angler wearing gloves or other winter protective gear to operate the plunger 98, avoiding the potential of an ice angler's bare fingers getting stuck to the pole or pinched between the hole and the spring loaded button. The actuator assembly 80 also protects the plunger assembly 106 from the elements, minimizing the risk of the plunger 98 freezing in the locked position.

Where a range of values is provided, it is understood that each intervening value, to the tenth of the unit of the lower limit unless the context clearly dictates otherwise, between the upper and lower limit of that range and any other stated or intervening value in that stated range is encompassed within the inventions. The upper and lower limits of these smaller ranges which may independently be included in the smaller ranges is also encompassed within the inventions, subject to any specifically excluded limit in the stated range. Where the stated range includes one or both of the limits, ranges excluding either both of those included limits are also included in the inventions.

Unless defined otherwise, all technical and scientific terms used herein have the same meaning as commonly understood by one of ordinary skill in the art to which these inventions belong. Although any methods and materials similar or equivalent to those described herein can also be used in the practice or testing of the present inventions, the preferred methods and materials are now described. All patents and publications mentioned herein, including those cited in the Background of the application, are hereby incorporated by reference to disclose and described the methods and/or materials in connection with which the publications are cited.

The publications discussed herein are provided solely for their disclosure prior to the filing date of the present application. Nothing herein is to be construed as an admission that the present inventions are not entitled to antedate such publication by virtue of prior invention. Further, the dates of publication provided may be different from the actual publication dates which may need to be independently confirmed.

Other embodiments of the invention are possible. Although the description above contains much specificity, these should not be construed as limiting the scope of the invention, but as merely providing illustrations of some of the presently preferred embodiments of this invention. It is also contemplated that various combinations or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

Thus the scope of this invention should be determined by the appended claims and their legal equivalents. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims.

What is claimed is:

1. An ice house comprising:

a collapsible frame assembly including;

at least one first pole including a connecting end with a plunger assembly;

at least one second pole with a hollow end sized to telescopically engage with the plunger assembly and the first pole, the second pole having a first detent and a second detent, wherein the first detent is proximate the hollow end and sized to releasably engage with a plunger on the plunger assembly;

an actuator assembly including a first end secured to the hollow end of the second pole by a member extending into the second detent, and a second end adapted to telescopically receive the plunger assembly and the first pole, the actuator assembly including an actuator attached to the actuator assembly by an elongated flexible region that permits the actuator to flex between a relaxed position and a depressed position, the elongated flexible region of the actuator extending from the second end toward the first end of the actuator assembly and being located over the detent and configured to flex between a relaxed position and a depressed position that disengages the plunger from the detent to release the first pole from the second pole;

a seat assembly secured to the frame assembly; and a cover including at least one door provided over the frame assembly.

2. The ice house according to claim 1 wherein the actuator assembly shields the plunger assembly from ice and snow.

3. The ice house according to claim 1 wherein the elongated flexible region comprises one of a mechanical hinge, a living hinge, or a flexible web.

4. The ice house according to claim 1 wherein the actuator comprises a protrusion opposite the detent that depresses the plunger into the hollow end of the second pole.

5. The ice house according to claim 1 wherein a distal end of the actuator is located over the detent so that a force applied to an external surface of the actuator is concentrated on the plunger.

6. The ice house according to claim 1 wherein the actuator comprises an external surface with a surface area at least 10 times greater than a surface area of a distal end of the plunger.

7. The ice house according to claim 1 wherein the collapsible frame assembly is secured to a sled.

8. The ice house according to claim 1 comprising a raised feature aligned with the plunger located on an external surface of the actuator.

9. The ice house according to claim 1 wherein the plunger assembly comprises:

a housing having a diameter sized to fit in a hollow end of the first pole; and a spring located in a recess in the housing and configured to bias the plunger through a hole in the connecting end of the first pole.

10. The ice house according to claim 1 wherein the plunger assembly comprises an alignment member extending beyond the connecting end and sized to fit in the hollow end of the second pole.

11. The ice house according to claim 1 wherein the actuator assembly permits one handed operation of the plunger assembly.

12. The ice house according to claim 1 wherein the cover further comprises at least one skylight.

13. The ice house according to claim 1 wherein the cover further comprises at least one vent.

14. The ice house according to claim 1 wherein the cover further comprises at least one skylight including a removable vinyl portion.

* * * * *